United States Patent [19]

Kane et al.

[11] Patent Number: 4,752,657

[45] Date of Patent: Jun. 21, 1988

[54] PROXIMITY SWITCH MOUNTING APPARATUS

[75] Inventors: John P. Kane, Sterling Heights; Billy Davenport, Berkley; Ray Sidelinker, Royal Oak, all of Mich.

[73] Assignee: Allied Automation Systems, Inc., Detroit, Mich.

[21] Appl. No.: 46,793

[22] Filed: May 7, 1987

[51] Int. Cl.[4] ..... H01H 35/38

[52] U.S. Cl. ..... 200/82 E; 73/745; 200/82 R; 335/205

[58] Field of Search ..... 335/205; 91/1; 92/5 R; 248/214; 200/82 R, 82 E, 293, 294, 303, 47, 286, 307, 61.41, 153 T, 82 C, 82 D, 81.4, 81 R, 81.5; 361/178–180; 307/118; 73/745

[56] References Cited

U.S. PATENT DOCUMENTS 4,086,456 4/1978 Bone ..... 200/82 E 4,161,685 7/1979 Jacob ..... 335/205

4,594,487 6/1986 Grassl ..... 200/82 E 4,680,436 7/1987 Brausfeld ..... 200/82 E

*Primary Examiner*—G. P. Tolin

*Attorney, Agent, or Firm*—Basile and Hanlon

[57] ABSTRACT

A mounting apparatus for a proximity switch for sensing the position of a piston within a fluid operated, expandable chamber cylinder. The mounting device comprises a block shaped member with at least a first depressed, arcuate surface, the degree of curvature of which is adapted to fit the surface of the cylinder. By first attaching the mounting apparatus to the proximity switch and then positioning the proximity switch with respect to the fluid cylinder, tightening down of fastening devices provided for the proximity switch will cause the arcuate surface to firmly engage the surface of the cylinder, thereby providing a secure, vibration resistant mounting of the proximity switch to the cylinder.

5 Claims, 1 Drawing Sheet

PROXIMITY SWITCH MOUNTING APPARATUS

BACKGROUND OF THE INVENTION

1. Field of the Invention:

This invention relates in general to the field of proximity switches for sensing the position of a piston within a fluid operated, expansible chamber cylinder, and more specifically to the field of a mounting device which provides a secure, vibration-resistant mounting of the proximity switch to the cylinder.

2. Description of the Prior Art:

In the use of fluid operated, expansible chamber cylinders, it has been common to use magnetic switches for sensing the position of the piston within the cylinder. The magnetic switch is typically a magnetic reed switch and opens and closes in response to a magnetic flux produced by a permanent magnet attached to a piston within the cylinder. Movement of the piston and the magnet carried thereon varies the magnetic flux and opens and closes the associated reed switch. Proximity switches of this type are very widely used for such applications as automatic cylinder cycling, light indication, cylinder programming and sequencing, multi-position signalling, machining applications, etc. Their use permits the elimination of a large number of mechanical elements formally associated with the use of mechanical limit switches, such as auxiliary gears, spiral rod extensions, switch dogs, mounting plates and cams.

Conventional proximity switches, such as those commercially available under the name Parker Fluidpower, are mounted on a tie-rod extending between the cylinder heads secured to each end of the cylinder. The proximity switch is provided with a J-shaped channel formed on one side thereof which is engageable with the tie-rod. A plurality of threaded bores, typically two, are formed in the proximity switch and extend through the longer side of the J-shaped channel. Externally threaded fastening devices are provided which are engageable with the threaded bores. These fastening devices are, typically, bolts and nuts. The proximity switch is mounted to the cylinder by engaging the tie-rod in the channel and tightening down the fastening devices until they abut tightly against the tie-rod.

Due to the manner of mounting the proximity switch, the device is subject to several types of failure in operation. Since the piston typically operates at high speeds, considerable vibration occurs in the body of the cylinder. The vibration tends to loosen the fastening devices, thus causing the proximity switch to slip and rotate around the tie-rod. Because of this rotation, the proximity switch is no longer positioned against a surface of the cylinder. An air gap is formed between the switch and the magnet disposed on the piston inside the cylinder and diminishes the magnitude of the magnetic flux experienced by the switch as the magnet passes by. This greatly diminishes the performance of the proximity switch.

In addition, since the proximity switch carries a number of electrical leads extending therefrom, it may easily be dislodged by accidental pulling or jerking of the leads. The force exerted on the leads will cause the switch to pivot around the tie rod into a dislodged position.

Several solutions have been proposed to this problem of slippage of the proximity switch, but all have proven unsatisfactory or impractical. Serrations have been provided to better grip the tie-rod. U.S. Pat. No. 4,086,456 proposes providing a tie-rod of hexagonal cross-section, instead of the typical circular cross-section. The proximity switch is provided with a first gripping surface which engages the tie-rod to position the switch with respect to the cylinder. A fastening plate is provided which has a second gripping surface for engaging the tie-rod and positioning the proximity switch. The plate is then tightened against the proximity switch by means of a fastening device. One of the surfaces of the proximity switch is made arcuate in shape to securely engage the surface of the cylinder.

While the above-referenced patent may be successful in providing a secure, vibration resistent mounting of the proximity switch to the cylinder, the device disclosed therein is not usable with the standard type of proximity switch and the standard type of tie-rod provided on a fluid cylinder. Thus, the problem of slippage with the standard type of proximity switch continues to exist.

It would be desirable to provide a simple means of securely mounting a proximity switch to a fluid cylinder which will resist dislodgement of the proximity switch due to vibration.

It would also be desirable to provide such a secure, vibration resistant mounting which may be used with a standard type of proximity switch and a fluid cylinder provided with a standard, circular tie-rod.

SUMMARY OF THE INVENTION

What is provided is a mounting device for use with a proximity switch for sensing the position of a piston within a fluid operated, expansible chamber cylinder, wherein the mounting device comprises a block shaped member with at least a first depressed arcuate surface, the degree of curvature of which surface is adaptable to fit to the curvature of the cylinder. Means are provided for mounting the mounting device to the proximity switch such that, when the proximity switch is positioned on the cylinder, the arcuate surface on the mounting device will securely engage a portion of the surface of the cylinder, thereby providing a secure, vibration resistant mounting of the proximity switch to the cylinder. Typically, the proximity switch is of the type provided with a J-shaped channel formed on a side thereof and engageable with a tie-rod extending between heads secured to each end of the cylinder and a plurality of externally threaded fastening devices engageable with a plurality of threaded through bores formed in the longer side of the J-shaped channel. The proximity switch may be positioned with respect to the cylinder by engaging the tie-rod in the channel. The means for mounting the mounting device to the proximity switch comprises an extension formed on a surface of the block shaped member adjacent the at least one arcuate surface. A plurality of through bores are formed in the extension and are adapted to engage the plurality of fastening devices. The plurality of bores formed in the extension are alignable with the pluality of threaded bores formed in the channel of the proximity switch, and the fastening devices may be threaded through the aligned bores in such a matter that, when the proximity switch is positioned with respect to the cylinder by means of engagement of the tie-rod in the channel, the tightening down of the fastening devices will cause the arcuate surface on the mounting device to securely engage a portion of the cylinder, thereby providing a secure, vibration resistant mounting of the proximity switch to the cylinder. By using vibration-proof nuts provided with nylon collars on the fastening devices, an even more secure mount may be provided.

A second depressed, arcuate surface may be formed on the side of the block shaped member opposite the first arcuate surface. If the degree of curvature of the second arcuate surface is made different of that from the first arcuate surface, reversing the orientating of the mounting apparatus end-to-end with respect to the fastening devices will permit the mounting device to be used with fluid cylinders of different diameters. Each arcuate surface will be usable with four or five different standard sized cylinders if the mounting device is comprised of a deformable material. Since fluid cylinders commonly come in standard sizes, by judicious selection of the degrees of curvature of the two arcuate surfaces, the mounting device will be usable for mounting a standard proximity switch to eight or ten different standard sized fluid cylinders.

In order to provide a secure, vibration free mounting of the proximity switch to different sized fluid cylinders, it is desirable to form the mounting device of a slightly deformable, resilient material. If the material is slightly deformable, tightening down of the fastening means will cause the ends of the arcuate surface to firmly engage the surface of the cylinder. This engagement causes the resilient mounting device to flex in a spring-like fashion so as to tightly secure it into engagement with the cylinder surface, even if there are slight irregularities in the sizes or shapes of the various members. Typically, the slightly deformable resilient material of which the mounting device is formed will be a polymeric material exhibiting the desired properties.

BRIEF DESCRIPTION OF THE DRAWING

The various features, advantages and other uses of the present invention will become more apparent by referring to the following detailed description and drawing in which.

DETAILED DESCRIPTION OF THE PREFERRED EMBODIMENTS

Figure 1:
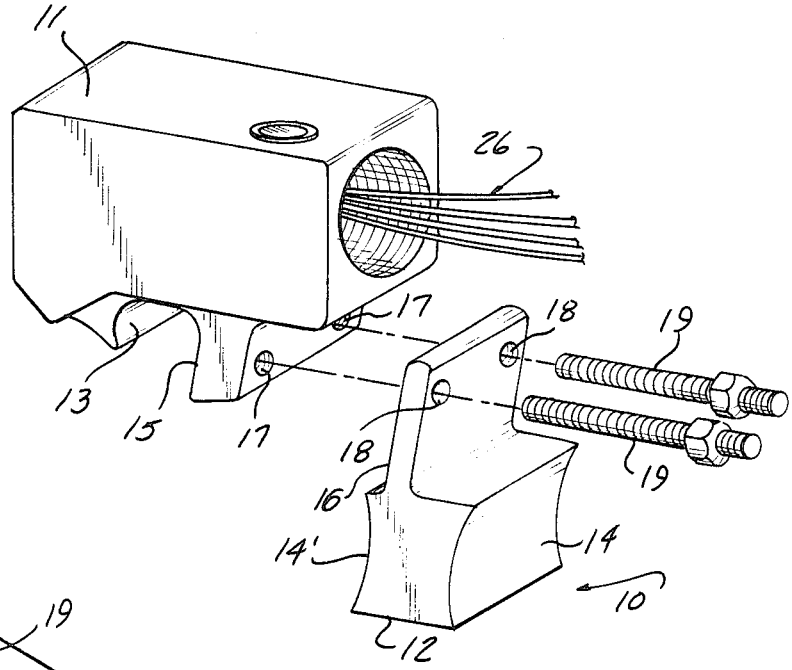
FIG. 1 is an exploded, perspective view of a proximity switch and mounting apparatus of the present invention, showing the relation therebetween.

Throughout the following description and drawing, identical reference numbers are used to refer to the same components shown in multiple figures of the drawing.

Figure 2:
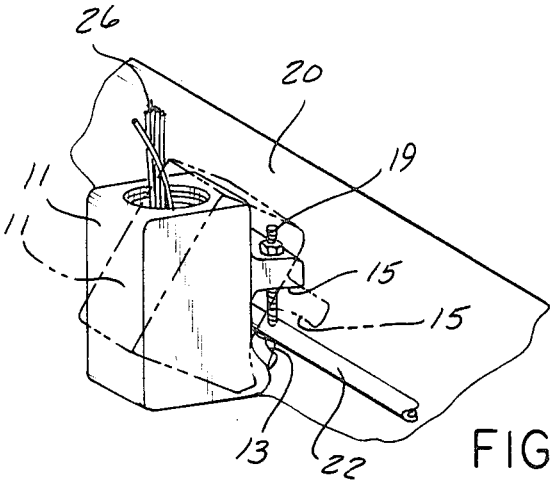
FIG-2 PRIOR ART
FIG. 2 is a perspective view of a proximity switch mounted to a fluid operated, expansible chamber cylinder, showing in phantom the proximity switch after it has slipped from its correct position due to operation of the fluid cylinder.
Figure 3:
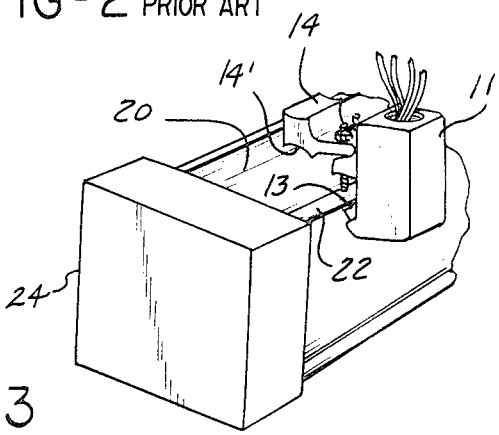
FIG. 3 is a perspective view of the fluid cylinder and proximity switch depicted in FIG. 2 with the proximity switch being mounted on the fluid cylinder by means of a mounting apparatus constructed in accordance with the teachings of the present invention.

Referring now to the drawing, and to FIG. 1 in particular, there is illustrated a standard proximity switch 11 for use in sensing the position of a piston within a fluid operated, expansible chamber cylinder, said fluid cylinder 20 being depicted in FIGS. 2 and 3. The proximity switch 11 has formed on the lower surface thereof a J-shaped channel 13. Threaded through bores 17 are formed in the proximity switch 11 and extend through the longer side 15 of the J-shaped channel 13. Fastening devices 19, which are depicted as threaded bolts carrying vibration-proof nuts provided with nylon collars, are threadingly engageable with through bores 17.

Standard proximity switch 11 has heretofore been mounted to fluid cylinder 20 in the manner depicted in FIG. 2. J-shaped channel 13 is positioned on tie-rod 22 which extends between cylinder heads, one of which is depicated as 24 in FIG. 3, secured to each end of cylinder 20. When proximity switch 11 is correctly positioned with respect to cylinder 20, part of proximity switch 11 will be in direct contact with the surface of cylinder 20. By tightening down fastening devices 19 which are threadingly engaged with through bores 17, fastening devices 19 will abut the tie-rod 22, thereby causing the proximity switch 11 to be secured in the correct position. However, as depicated by the phantom lines in FIG. 2, the vibrations caused by continual operation of cylinder 20 will cause fastening devices 19 to loosen to the point where they no longer tightly abut against tie-rod 22. Since the tight abutment between fastening devices 19 and tie-rod 22 is the only securing point for proximity switch 11 with respect to cylinder 20, the loss of the tight abutment due to the vibrations will cause proximity switch 11 to slip from its correct position to the position indicated by the phantom lines. In the slipped position depicted, in the body of proximity switch 11 is no longer directly in contact with the surface of cylinder 20. This lack of contact severely impairs the performance of proximity switch 11.

A proximity switch mounting apparatus 10 constructed in accordance with the instant invention is depicated in FIG. 1. The proximity switch 10 is comprised of a block shaped member 12 which has formed thereon two opposed, depressed, arcuate surfaces 14 and 14'. The degrees of curvature of arcuate surfaces 14, 14' are such that one of the arcuate surfaces, such as surface 14', will adapt to the degree of curvature of four or five different standard sized cylinders. The degree of curvature of arcuate surface 14 will adapt to that of the surface of different sized, smaller cylinders (not shown).

An extension 16 is formed on a side of block shaped member 12 adjacent arcuate surfaces 14, 14'. Formed in extension 16 are through bores 18. The location and number of through bores 18 correspond with the location and number of threaded through bores 17 formed in the proximity switch 11. Through bores 18 are adapted to engage fastening means 19.

With the aid of mounting device 12, proximity switch 11 may be mounted to cylinder head 20 in a secure and vibration resistant manner. FIG. 3 illustrates how the device of the present invention is employed to provide such a secure and vibration resistant mounting. Instead of merely engaging fastening means 19 with threaded through bores 17 and tightening down to abut tie-rod 22, the through bores 18 formed in the mounting apparatus 14 are first aligned with the threaded through bores 17 formed in the proximity switch 11. The fastening device 19 are then passed through the through bores 18 and then threadingly engaged with threaded through bores 17 to attach mounting device 10 to proximity switch 11. Proximity switch 11 with mounting device 10 attached thereto is then positioned on tie-rod 22 in the usual manner. The presence of mounting apparatus 10 will cause proximity switch 11 to be positioned in the correct manner so that it contacts the surface of cylinder 20. When the fastening device 19 are tightened down, the arcuate surface 14' will be forced against the surface of the cylinder 20. Hence, instead of merely relying on the abutment of fastening devices 19 agaisnt the tie-rod 22, the use of mounting apparatus 10 provides a much more secure, two-point mounting to proximity switch 11. Because the arcuate surface 14' of mounting device 10 securely enages the surface of the cylinder, proximity switch 11 will be unable to slip out of the position, even if fastening devices 19 become loosened due to operation of cylinder 20.

Because proximity switch 11 is normally equipped with leads 26 extending therefrom, such a swtich 11 mounted and depicted in FIG. 2 will be especially prone to slip out of position should any force be exerted on proximity switch 11 through leads 26. If leads 26 are, for example, accidently pulled or stretched, proximity switch 11 is free to pivot around the tie-rod 22, especially if fastening devices 19 are even only slightly loose. In contrast, any force exerted by displacement of leads 26 on the proximity switch 11 mounted in the manner depicated in FIG. 3 will not cause such slippage and displacement. Due to the presence of mounting apparatus 10, proximity switch 11 is no longer free to pivot around tie-rod 22. Thus a proximity switch mounted with the device of the instant invention provides a secure mounting to the fluid cylinder which is not only resistant to vibration, but will not be dislodged due to extranseous axial or rotational forces exerted thereon.

While the herein disclosed invention has been described with reference to certain embodiments and exemplifications thereof, it is not intended to be so limited but solely by the claims appended hereto.

We claim:

1. In a proximity switch of the type having a J-shaped channel formed on a side thereof engaged with a tie-rod extending between heads secured to each end of a fluid operated, expansible chamber cylinder and a plurality of externally threaded fastening devices engaged with a plurality of threaded bores formed in said proximity switch and extending through the longer side of the channel, wherein the proximity switch is positioned on the cylinder by engaging the tie-rod in the channel, the improvement which comprises a mounting device having:

a block shaped member with at least a first concave arcuate surface, the degree of curvature of which surface fitting the degree of curvature of the surface of the cylinder;

an extension formed on a surface of the block shaped member adjacent the arcuate surface; and a plurality of bores corresponding to the plurality of threaded bores formed in the proximity switch, said plurality of bores being formed through the extension and engaging the plurality of fastening devices, wherein the plurality of bores formed through the extension are aligned with the plurality of threaded bores formed in the channel of the proximity switch and the fastening devices threaded through the aligned bores to position the proximity switch with respect to the cylinder by engagement of the tie-rod in the channel, and the fastening devices are tightened down to cause the arcuate surface on the mounting device to securely engage a portion of the surface of the cylinder, thereby providing a secure, vibration resistant mounting of the proximity switch to the cylinder.

2. The proximity switch of claim 1 further comprising a second, concave, arcuate surface formed on a side of the block shaped member opposed to the first arcuate surface, the degree of curvature of the second arcuate surface being different from that of the first arcuate surface such that, by reversing the orientation of the mounting device with respect to the fastening devices, the mounting device may be used with fluid cylinders of different diameters.

3. The proximity switch of claim 1 wherein the block shaped member is formed of a slightly deformable, resilient material.

4. The proximity switch of claim 3 wherein the material is a polymeric material.

5. The proximity switch of claim 1 further comprising vibration-proof nuts in engagement with the threaded fastening devices.

* * * * *